US008128010B2

(12) United States Patent
Sabe

(10) Patent No.: US 8,128,010 B2
(45) Date of Patent: Mar. 6, 2012

(54) WASTE TONER CARTRIDGE PROCESSING EQUIPMENT

(75) Inventor: Yoshimitsu Sabe, Kanagawa-Ken (JP)

(73) Assignee: ATROS Corporation, Niigata-ken (JP)

( * ) Notice: Subject to any disclaimer, the term of this patent is extended or adjusted under 35 U.S.C. 154(b) by 269 days.

(21) Appl. No.: 12/575,148

(22) Filed: Oct. 7, 2009

(65) Prior Publication Data

US 2010/0086337 A1 Apr. 8, 2010

(30) Foreign Application Priority Data

Oct. 8, 2008 (JP) ..... 2008-261296

(51) Int. Cl.
*B02C 17/00* (2006.01)
*B02C 17/02* (2006.01)

(52) U.S. Cl. ..... 241/24.11; 241/41; 241/101.2

(58) Field of Classification Search ..... 241/24.11, 241/38, 41, 101.2
See application file for complete search history.

(56) References Cited

U.S. PATENT DOCUMENTS

| | | | | |
|---|---|---|---|---|
| 5,624,079 | A * | 4/1997 | Higuchi et al. | 241/39 |
| 6,047,910 | A * | 4/2000 | Murphy | 241/21 |
| 6,716,401 | B2 * | 4/2004 | Benson | 422/297 |
| 2008/0179435 | A1 * | 7/2008 | Martinell et al. | 241/62 |
| 2009/0050719 | A1 * | 2/2009 | Lippert et al. | 241/17 |

FOREIGN PATENT DOCUMENTS

JP 2002-079125 3/2002

* cited by examiner

*Primary Examiner* — Bena Miller
(74) *Attorney, Agent, or Firm* — Blank Rome LLP

(57) ABSTRACT

In a waste toner cartridge processing equipment (100) including a crushing means (303) for crushing a waste toner cartridge (101) and extracting various materials (106 to 108) constituting the waste toner cartridge, the crushing means (303) performs crushing while spraying water (104).

2 Claims, 2 Drawing Sheets

WASTE TONER CARTRIDGE PROCESSING EQUIPMENT

CROSS-REFERENCE TO RELATED APPLICATION

This application is based upon and claims the benefit of priority from the prior Japanese Patent Application No. 2008-261296, filed Oct. 8, 2008, the entire contents of which is incorporated herein by reference.

BACKGROUND OF THE INVENTION

1. Field of the Invention

The present invention relates to waste toner cartridge processing equipment which can recover and recycle various natural resources from waste toner cartridges.

2. Description of the Related Art

The primary material of toner used as ink for electrostatic latent image type printers, copiers, and image transmission devices is powdered pigmented plastic. However, because of being in a "powder" form, the toner easily scatters around the surrounding area during ink-refilling and therefore careful handling is required. For this reason, the toner is ordinarily stored in a container (referred to as a toner cartridge) and distributed to a user. The user replaces this toner cartridge as it is.

A used toner cartridge (waste toner cartridge) is discarded as noncombustible waste without being recycled. Alternatively, only the container (cartridge) is reused. Although the latter is preferable in terms of recycling resources, the number of times the cartridge can be reused is limited, and the cartridge is ultimately discarded as noncombustible waste.

Therefore, a processing technology is required in which, while finely crushing a waste toner cartridge and performing separation and recovery of the toner ingredients, various raw materials constituting the toner cartridge can also be separated and recovered.

As a processing technology such as this, for example, a technology described in Japanese Patent Application Laid-Open (Kokai) Publication No. 2002-79125 is known.

The technology described in this publication will be hereinafter referred to as conventional art. In the abstract of this conventional art, to solve the problem of "providing a used toner cartridge treatment device capable of crushing a toner cartridge under safe and good environmental conditions and subjecting the cartridge to separate treatment for each of the constituent materials of the cartridge, even when the used cartridge, as it is, is charged into the device without performing any handwork and without disassembling the cartridge", the solution of "a crusher for crushing a used toner cartridge in a closed crushing chamber while maintaining the atmosphere within the crushing chamber in such a state that the oxygen concentration in the atmosphere is lower than the explosion limit, and a separator for separating the crushed material discharged from the crusher into constituent materials of the cartridge" is disclosed. As a result of the solution, "by only charging a used toner cartridge for a copying machine, or the like, as a cartridge integral body as it is, into the device without requiring any pretreatment handwork for bringing the cartridge into an almost disassembled state, constituent materials of the cartridge, such as residual toner, metal (e.g. iron and nonferrous metal), glass and plastic material, are safely and automatically subjected to separate recovery from each other without any risk of causing explosion. Accordingly, the used toner cartridge may be treated with remarkably high efficiency, through very simple, clean and safe treatment work, by using such a simple treatment device, and further, at a low cost as a whole".

However, the above-described conventional art has the following problems.

(a) A first problem in the conventional art is as follows. According to the description in paragraph [0021] of the publication, the "closed crushing chamber" refers to a shredder 4 configured in an overall airtight (sealed) state. Also, "atmosphere lower than the explosion limit" refers to an atmosphere of nitrogen gas (an oxygen gas concentration of 7% or less is preferable). However, the shredder 4 (crushing chamber) is not constantly sealed. Every time a waste toner cartridge is placed into the shredder 4, the sealed state is broken and nitrogen gas escapes to the outside.

This is also clear from the description in paragraph [0022] of the publication stating that "an opening and closing device 7 including double doors opening outward is provided on the lower end of the bunker 3. Opening and closing of the opening and closing device 7 allow the used toner cartridge 1 to be adjusted to an appropriate amount and stably fed to the shredder 4". The shredder 4 (crushing chamber) is opened to the external environment by the opening and closing device 7 being "opened".

Therefore, there is a problem in the conventional art that the shredder 4 is required to be re-filled with nitrogen gas after a waste toner cartridge is loaded into the shredder 4, and the consumption cost of nitrogen gas increases accordingly. In addition, because filling the shredder 4 with nitrogen gas requires time depending on the chamber volume, the crushing operation is required to be interrupted during this period. Therefore, the processing efficiency of the crushing operation is poor.

(b) A second problem in the conventional art is as follows. The crushed materials in the conventional art are obtained by a chain 10 that rotates at high speed (refer to paragraph [0023] of the publication). That is, the crushed materials are merely materials that have been mechanically crushed in an atmosphere lower than the explosion limit. Therefore, there is a problem that the crushed materials are in a contaminated state covered with toner, and even when the crushed materials are "separated into each constituent material of the cartridge by a separator", these materials, which have been contaminated, cannot be reused as they are.

SUMMARY OF THE INVENTION

The present invention has been conceived to solve the above-described problems. The object of the present invention is to provide a waste toner cartridge processing equipment that enhances processing efficiency by allowing continuous crushing operations and enables separated materials to be reused as they are.

In order to achieve the above-described object, in accordance with one aspect of the present invention, there is provided a waste toner cartridge processing equipment, comprising: a crushing means for crushing a waste toner cartridge and extracting various materials which constitute the waste toner cartridge; wherein the crushing means performs crushing while spraying water.

In accordance with another aspect of the present invention, there is provided the waste toner cartridge processing equipment further comprising: a toner separating means for, after dehydration processing of wastewater from the crushing means and adding a solvent to the waste toner to become a gelled state, performing gel separation to extract a pigmented plastic which is the toner main ingredient.

In accordance with another aspect of the present invention, there is provided the waste toner cartridge processing equipment further comprising: a dehydrating means for extracting and dehydrating suspended materials having a low specific gravity from the wastewater with the flocculating agent added; wherein the toner separating means, after dehydration and subsequently adding the solvent to the suspended materials, performs gel separation to extract the pigmented plastic which is the toner main ingredient.

According to the present invention, a waste toner cartridge processing equipment can be provided that enhances processing efficiency by allowing continuous crushing operations and enables separated materials to be reused as they are.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENT

The present invention will hereinafter be described in detail with reference to the preferred embodiment shown in the accompanying drawings.

A. Overall Configuration

Figure 1:
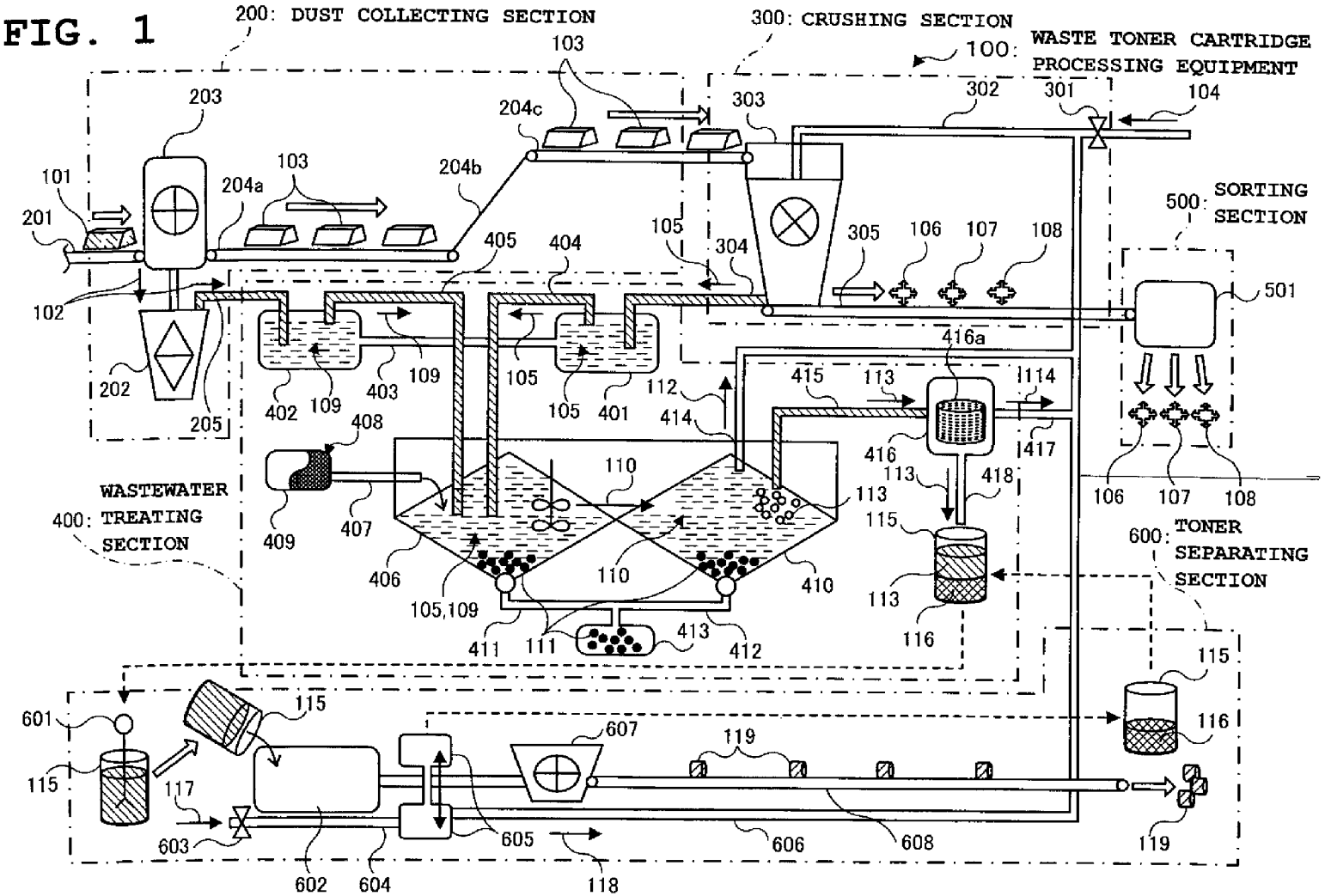
FIG. 1 is an overall configuration diagram of a waste toner cartridge processing equipment according to an embodiment of the present invention.

FIG. 1 is an overall configuration diagram of a waste toner cartridge processing equipment according to an embodiment.

In FIG. 1, the waste toner cartridge processing equipment 100 can be schematically divided into a dust collecting section 200, a crushing section 300, a wastewater treating section 400, a sorting section 500, and a toner separating section 600.

Details of each section are as follows. First, the dust collecting section 200 includes a conveyor 201, a dust collecting chamber 203, conveyors 204*a*, 204*b*, and 204*c*, and a discharge pipe 205. The conveyor 201 carries a collected waste toner cartridge 101. The dust collecting chamber 203 collects contaminants 102, such as toner, attached to the waste toner cartridge 101 carried by the conveyor 201 by operating a dust collector 202, and cleans the waste toner cartridge 101. The conveyors 204*a*, 204*b*, and 204*c* carry a cleaned waste toner cartridge 103 from the dust collecting chamber 203. The discharge pipe 205 discharges the contaminants 102 collected by the dust collector 202 into the wastewater treating section 400.

The crushing section 300 includes a washing crusher 303, a discharge pipe 304, and a conveyor 305. The washing crusher 303 crushes the waste toner cartridge 103 carried by the conveyors 204*a*, 204*b*, and 204*c* into small pieces by a mechanical means (such as a rotary blade, an endless chain, or meshing blades) while spraying fresh water 104 (clean water such as tap water, groundwater, or reclaimed water described hereafter) supplied from a water supply pipe 302 connected to an external water source (not shown) via an opening and closing valve 301. The discharge pipe 304 discharges wastewater 105 from the washing crusher 303 into the wastewater treating section 400. The conveyor 305 carries various crushed materials 106 to 108 taken from the washing crusher 303 to the sorting section 500.

The wastewater treating section 400 includes a first wastewater pit 401 and a second wastewater pit 402. The first wastewater pit 401 stores therein the wastewater 105 discharged from the crushing section 300 via the discharge pipe 304. The second wastewater pit 402 stores the contaminants 102 from the dust collecting section 200 discharged via the discharge pipe 205. The first wastewater pit 401 and the second wastewater pit 402 are interconnected by a pipe line 403, and the wastewater 105 in the first wastewater pit 401 flows into the second wastewater pit 402 via the pipe line 403. Therefore, although the contaminants 102 stored in the second wastewater pit 402 are initially in dust form, these contaminants 102 mix with the wastewater 105 flowed from the first wastewater pit 401, forming a similar wastewater 109.

The wastewater treating section 400 also includes a discharge pipe 404, a discharge pipe 405, a stirrer 406, and a flocculating agent feeder 409. The discharge pipe 404 discharges the wastewater 105 overflowed from the first wastewater pit 401. The discharge pipe 405 discharges the wastewater 109 overflowed from the second wastewater pit 402. The stirrer 406 stirs the wastewater 105 flowed from the discharge pipe 404 and the wastewater 109 flowed from the discharge pipe 405. The flocculating agent feeder 409 feeds a predetermined flocculating agent 408 into the stirrer 406 via a pipe 407. The flocculating agent 408 is an additive that neutralizes negatively charged particles in the wastewaters 105 and 109 with positive charge and flocculates the particles. For example, "Eco Max TW-20" (registered trademark) manufactured by Aisan Industry Co., Ltd. may be used. "Eco Max TW-20", which includes aluminum sulfate and alumina-silicate composite having positive charge, is capable of neutralizing the surface potential of the (negatively charged) particles included in the wastewater 105 and 109 by the effect of the positive charge, and as a result floc (a clump of particles bound together with the flocculating agent 408 as a core) that does not re-elute can be formed.

In addition, the wastewater treating section 400 includes a settling tank 410, a sediment storing section 413, a pipe 414, and a dehydrator 416. The settling tank 410 is provided adjacent to the stirrer 406, and wastewater 110 (the wastewater 105 and the wastewater 109 to which the flocculating agent 408 has been added) overflowed from the stirrer 406 flows into this settling tank 410. The sediment storing section 413 takes in and stores sediments 111 in the bottom portion of the stirrer 406 and the settling tank 410 via pipes 411 and 412. The pipe 414 returns clear water near the top portion of the settling tank 410 to the water supply pipe 302 as reclaimed water 112. The dehydrator 416 includes a high-speed rotation dehydrating tank 416*a*. The dehydrating tank 416*a* takes in suspended materials 113 near the middle portion of the settling tank 410 and water via a pipe 415, and after dehydrating them, separates and extracts the suspended materials 113. The water separated from the suspended materials 113 by dehydration is returned to the water supply pipe 302 from the dehydrator 416 via a pipe 417 as reclaimed water 114, and the dehydrated suspended materials 113 are sent to a drum-shaped carrying container 115 via a pipe 418.

Here, as time goes on, materials having a high specific gravity (primarily magnetic materials included in the toner [iron oxide]) in the wastewater 110 sink to the bottom portion of the settling tank 410 as the sediments 111, and materials having a low specific gravity (primarily pigmented plastics included in the toner) float to near the middle portion of the settling tank 410 as the suspended materials 113. Clear water (reclaimed water 112) is found near the top portion of the settling tank 410. That is, in the wastewater treating section 400, by specific gravity separation, primarily magnetic materials included in the toner (iron oxide) are separated into the sediments 111, and primarily pigmented plastics included in the toner are separated into the suspended materials 113. The sediments 111 (iron oxide) having a high specific gravity are sent to the sediment storing section 413, and the suspended materials 113 (pigmented plastic) having a low specific gravity are sent to the dehydrator 416. The clear water that does not include either sediments 111 or suspended materials 113 is reused as the reclaimed water 112.

The dehydrated suspended materials 113 are sent via the pipe 418 to the carrying container 115 in which a predetermined special solvent 116 has been put in advance. The special solvent 116 gels the suspended materials 113 which are in a sludge state as a result of dehydration (that is, the special solvent 116 changes the suspended materials 113 to a low-adhesion solid having no fluidity). For example, "ATROS solvent" (registered trademark) manufactured by Atros Co., Ltd. may be used. The ATROS solvent is a "toner dust control gelling agent that includes aromatic and aliphatic hydrocarbons, in which the aliphatic hydrocarbon is a paraffin oil fraction of which the boiling point is 150 degrees to 200 degrees under atmospheric pressure".

Note that an operation for putting the special solvent 116 in the carrying container 115 is required only at the initial operation. This is because, as described hereafter, in the toner separating section 600, toner ingredients and the special solvent 116 are separated from the gelled suspended material 113, and the separated special solvent 116 is, after being sent to the carrier container 115, returned to the toner separating section 600 again.

The sorting section 500 includes a sorter 501 that sorts the various crushed materials 106 to 108 sent from the crushing section 300 via the conveyor 305 into different types, based on differences in mass, differences in magnetic characteristics, and the like. Here, the crushed material 106 is "iron", the crushed material 107 is "plastic", and the crushed material 108 is "aluminum". The iron, plastic, and aluminum materials are primarily constituent elements of the cartridge. However, in addition to these materials, sealing materials such as rubber may be included.

The toner separating section 600 includes a stirrer 601, a gel separating section 602, a circulation type cooling section 605, a pipe 606, a crusher 607, and a conveyor 608. The stirrer 601 gels the suspended materials 113 and the special solvent 116 in the carrying container 115 carried from the wastewater treating section 400 by stirring and mixing. The gel separating section 602 separates the gelled suspended materials 113 and the special solvent 116. The cooling section 605 cools the separated suspended materials 113 using fresh water 117 (clean water such as tap water) supplied from the water supply pipe 302 connected to an external water source (not shown) via an opening and closing valve 603. The pipe 606 returns cooling water 118 from the cooling section 605 to the water supply pipe 302. The crusher 607 crushes the cooled suspended materials 113 into small pieces. The conveyor 608 carries crushed materials 119 removed from the crusher 607. The gel separating mechanism is as follows. When a gel (here, the suspended materials 113 mixed with the special solvent 116), which has been sent into a dry-distillation separation tank that is indirectly heated by thermal oil, is stirred and mixed, the vapor is condensed and liquefied, and remaining high-temperature solid materials are, after being pumped from the bottom of the tank and cooled, extracted as a hard resin. This cooling during gel separation is performed in order to change the high-temperature solid materials (hard resin) pumped from the bottom of the tank into a material that is easier to handle. That is, although the high-temperature solid materials pumped from the bottom of the tank are not solidified without being cooled or the like, when being cooled and solidified, the high-temperature solid material becomes a material that is easier to handle. The cooling water is water used merely for the cooling. Circulation type refers to a type in which cooling water effluent is reused as circulating water.

B. Processing Operations

The overall configuration of the waste toner cartridge processing equipment 100 according to the embodiment is as described above. Next, processing operations performed by the waste toner cartridge processing equipment 100 will be described with reference to a conceptual diagram.

Figure 2:
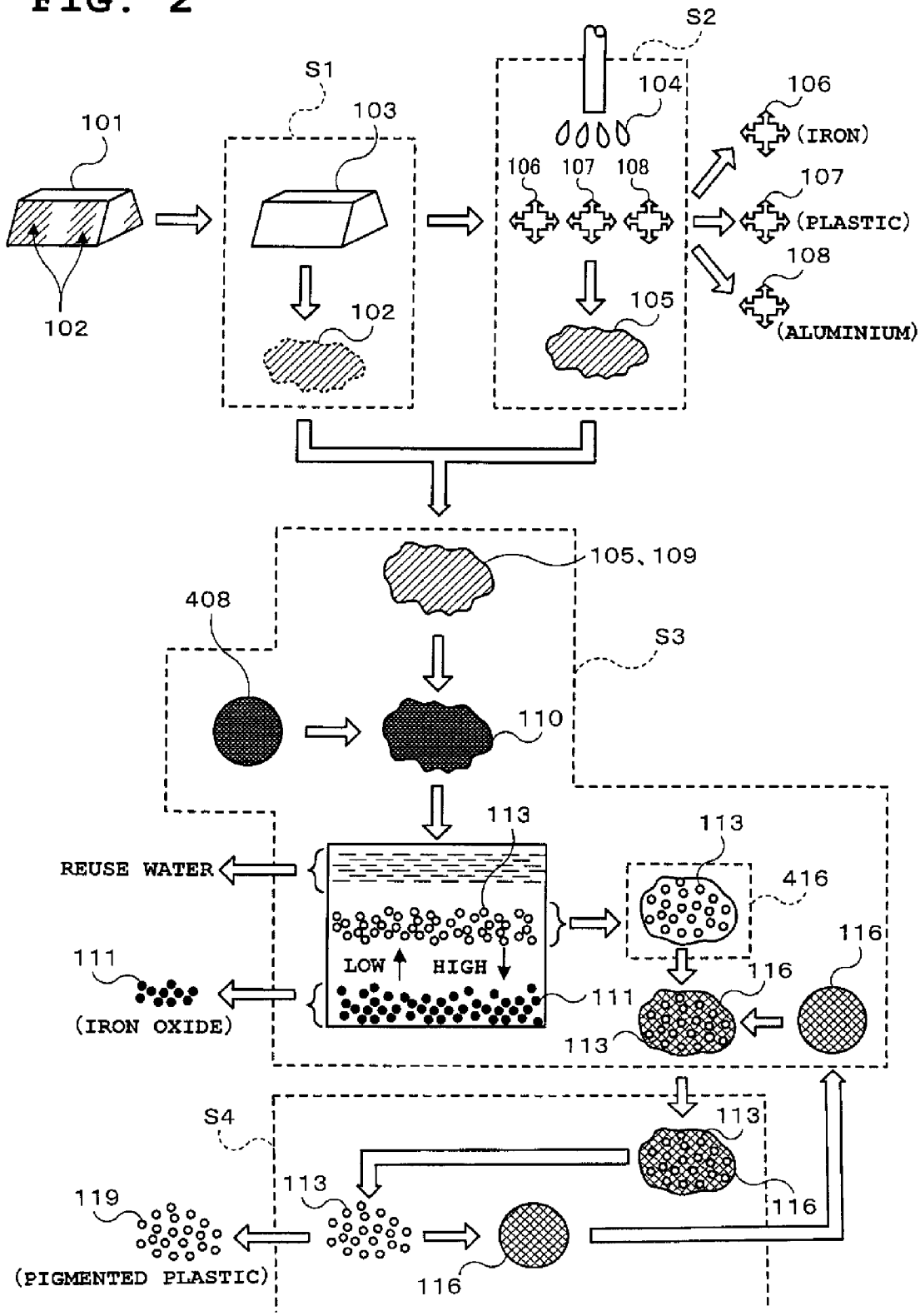
FIG. 2 is a conceptual diagram of a processing operation performed by the waste toner cartridge processing equipment 100 according to the embodiment of the present invention.

FIG. 2 is a conceptual diagram of the processing operations performed by the waste toner cartridge processing equipment 100 according to the embodiment.

(1) Dust Collecting Process (Step S1) Performed by the Dust Collecting Section 200

In this process, the dust collecting section 200 cleans the waste toner cartridge 101 covered with contaminants 102 such as toner, and removes the contaminants 102. The waste toner cartridge 101 from which the contaminants 102 have been removed and which is generally clean is sent to a crushing process (Step S2), and the collected contaminants 102 are sent to a wastewater treating process (Step S3).

(2) Crushing Process (Step S2) Performed by the Crushing Section 300 and the Sorting Section 500

In this process, the waste toner cartridge 103 is crushed into small pieces using the washing crusher 303. "Washing-crushing" processing, which is performed by the washing crusher 303, refers to processing in which a target object (the waste toner cartridge 103 in this instance) is crushed into small pieces by a predetermined means (a mechanical means such as a rotary blade, an endless chain, or meshing blades), while being sprayed with fresh water 104. This washing-crushing processing has the advantage of not generating dust accompanying crushing, and therefore does not degrade the surrounding environment, and causes no harm to the human body. In addition, since dust is not generated, the washing-crushing processing has an advantage in terms of safety in that there is no danger of a dust explosion occurring.

From the crushing process, the various crushed materials 106 to 108 that are constituent elements of the waste toner cartridge 103 are extracted. These crushed materials 106 to 108 are sorted by the sorter 501 into different types based on differences in mass, whether or not the material is magnetic or non-magnetic, and the like, and then after being boxed up or the like based on their types, shipped to market. For example, the crushed material 106 is "iron", the crushed material 107 is "plastic", and the crushed material 108 is "aluminum". Since these materials (iron, plastic, and aluminum) are materials that have been extracted from a target object crushed while being sprayed with fresh water 104 or, in other words, being washed with water, they are clean with no contamination by the toner or the like, and therefore can be immediately shipped after air-drying or forced-drying.

From this crushing process, the wastewater 105 resulting from the crushing-washing processing is discharged. This wastewater 105 is sent to the wastewater treating process (Step S3).

(3) Wastewater Treating Process (Step S3) Performed by the Wastewater Treating Section 400

In this process, the wastewater treating section 400 processes the wastewater 105 from the crushing process (Step S2) and the contaminants 102 from the dust collecting process (Step S1). In the process, the wastewater treating section 400 mixes and stirs the predetermined flocculating agent 408 and the wastewaters 105 and 109 including the contaminants 102, thereby flocculating the toner ingredients (iron oxide and pigmented plastic materials) included in the wastewaters 105 and 109 (wastewater 110).

The flocs (clumps of particles bound together by the flocculating agent 408) in the wastewater 110 are separated into the sediments 111 and the suspended materials 113 based on differences in specific gravity. The sediments 111, which are primarily magnetic bodies (iron oxide) included in the toner that have a high specific gravity, are gathered and periodically collected. On the other hand, the suspended materials 113 are primarily pigmented plastics included in the toner that have a low specific gravity, and these suspended materials 113 and water are sent to the dehydrator 416 and dehydrated therein. The dehydrated suspended materials 113 are in a sludge state, still including a small amount of water. The special solvent 116 is mixed into the sludge-like suspended materials 113, and these are then carried to a toner separating process (Step S4).

(4) Toner Separating Process (Step S4) Performed by the Toner Separating Section 600

In this process, first, the special solvent 116 and the suspended materials 113 are mixed and stirred, thereby gelling the suspended materials 113. Next, gel separation is performed. The separated suspended materials 113 (the pigmented plastics included in the toner) are crushed into small pieces and the crushed materials 119 are collected, while the separated special solvent 116 is returned to the toner separating process (Step S4) again.

As just described, according to the embodiment, as a result of (1) the dust collecting process (Step S1), (2) the crushing process (Step S2), (3) the wastewater treating process (Step S3), and (4) the toner separating process (Step S4) being sequentially performed, an excellent waste toner cartridge processing equipment 100 is actualized that enhances processing efficiency by allowing continuous crushing operations and enables separated materials to be reused as they are.

That is, the waste toner cartridge processing equipment 100 according to the embodiment performs crushing while spraying water rather than performing crushing in a nitrogen gas atmosphere as in the conventional art. Therefore, the waste toner cartridge processing equipment 100 is not required to be replenished with nitrogen gas every time a waste toner cartridge is placed therein. In other words, the crushing operation can be continued while continuously placing waste toner cartridges therein. Accordingly, a first advantage is obtained in that processing efficiency is enhanced by allowing continuous crushing operations.

In addition, the various crushed materials 106 to 108 that are constituent elements of the waste toner cartridge 103 are sorted and extracted from the waste toner cartridge 103 crushed while being sprayed with water (being washed). Therefore, the crushed materials 106 to 108 are clean with no contamination. Accordingly, a second advantage is obtained in that the crushed materials 106 to 108 can be dried and shipped as they are.

Moreover, generation of dust is suppressed by the washing-crushing processing. Therefore, the waste toner cartridge processing equipment 100 is not harmful to the environment and the human body, and the risk of "dust explosions" is infallibly prevented. Furthermore, since the washing water and the like are recovered and reused, the washing cost is reduced.

While the present invention has been described with reference to the preferred embodiments, it is intended that the invention be not limited by any of the details of the description therein but includes all the embodiments which fall within the scope of the appended claims.

What is claimed is:

1. A waste toner cartridge processing equipment, comprising:

a crushing means for crushing a waste toner cartridge and extracting various materials which constitute the waste toner cartridge; and a toner separating means for, after dehydration processing of wastewater from the crushing means and adding a solvent to the waste toner to become a gelled state, performing gel separation to extract a pigmented plastic which is the toner main ingredient, wherein the crushing means performs crushing while spraying water.

2. A waste toner cartridge processing equipment comprising:

a crushing means for crushing a waste toner cartridge and extracting various materials which constitute the waste toner cartridge;

a toner separating means for, after dehydration processing of wastewater from the crushing means and adding a solvent to the waste toner to become a gelled state, performing gel separation to extract a pigmented plastic which is the toner main ingredient; and a dehydrating means for extracting and dehydrating suspended materials having a low specific gravity from the wastewater with the flocculating agent added;

wherein the crushing means performs crushing while spraying water, wherein the toner separating means, after dehydration and subsequently adding the solvent to the suspended materials, performs gel separation to extract the pigmented plastic which is the toner main ingredient.

* * * * *